US008561579B2

(12) United States Patent
Snow

(10) Patent No.: US 8,561,579 B2
(45) Date of Patent: Oct. 22, 2013

(54) WATER/ALCOHOL INJECTION TUNING SYSTEM

(76) Inventor: Matthew Snow, Woodland Park, CO (US)

( * ) Notice: Subject to any disclaimer, the term of this patent is extended or adjusted under 35 U.S.C. 154(b) by 414 days.

(21) Appl. No.: 12/849,014

(22) Filed: Aug. 2, 2010

(65) Prior Publication Data

US 2010/0294233 A1 Nov. 25, 2010

Related U.S. Application Data

(62) Division of application No. 11/755,500, filed on May 30, 2007, now Pat. No. 7,779,817.

(51) Int. Cl.
*F02B 47/02* (2006.01)

(52) U.S. Cl.
USPC ..... 123/25 E; 123/3

(58) Field of Classification Search
USPC ..... 123/3, 472, 479, 488, 575, 676, 123/25 A–25 Q, 25 R
See application file for complete search history.

(56) References Cited

U.S. PATENT DOCUMENTS

| | | | | |
|---|---|---|---|---|
| 3,834,361 | A * | 9/1974 | Keely | 123/479 |
| 4,756,186 | A * | 7/1988 | Sangawa | 73/114.61 |
| 4,993,386 | A * | 2/1991 | Ozasa et al. | 123/25 J |
| 5,201,296 | A * | 4/1993 | Wunning et al. | 123/479 |
| 6,112,705 | A * | 9/2000 | Nakayama et al. | 123/25 C |
| 6,339,737 | B1 * | 1/2002 | Yoshimura et al. | 701/50 |
| 6,532,911 | B2 * | 3/2003 | Suzuki et al. | 123/41.14 |
| 2006/0249102 | A1 * | 11/2006 | Morgan et al. | 123/25 J |

FOREIGN PATENT DOCUMENTS

GB 2259326 A * 10/1993

OTHER PUBLICATIONS

Aquamist System 2d, May 30, 2007, 2 pages, published by Aquamist; webiste located at: http://www.aquamist.co.uk/cp/806-009/806-009.html; This is a 3-D water/alcohol injection system adapted to keep track of fuel flow.

Aquamist System 2s, May 30, 2007, 2 pages, published by Aquamist; webiste located at: http://www.aquamist.co.uk/cp/sys2/sys2a.html; This is a water/alcohol injection system adapted to detect blocked water jets.

* cited by examiner

*Primary Examiner* — Hung Q Nguyen
(74) *Attorney, Agent, or Firm* — Leyendecker and Lemire, LLC

(57) ABSTRACT

An injection system for injecting one or both of water and alcohol into an internal combustion engine includes a system monitor, a control module and a mixture delivery system. The system monitor can have a parameter level display, the control module can be adapted to receive one or more user-supplied parameters and the control module can be further adapted to store the one or more user-supplied parameters. The control module can also be comprised of a plurality of connectors and at least one electrical signal generator. The injection system can also be comprised of electrical wiring and a mixture delivery system having a pressure source.

11 Claims, 7 Drawing Sheets

WATER/ALCOHOL INJECTION TUNING SYSTEM

INCORPORATION BY REFERENCE

The application is a divisional of and claims priority to nonprovisional application Ser. No. 11/755,500 filed on May 30, 2007 entitled "Water/Alcohol Injection Tuning System," the full disclosure of which is incorporated herein by reference. Application Ser. No. 11/755,500 incorporates fully by reference provisional application No. 60/597,266 filed on Nov. 18, 2005 entitled "Water/alcohol injection flow switch safety device" and nonprovisional application Ser. No. 11/561,889 filed on Nov. 20, 2006 entitled "Water/Alcohol Injection Flow Switch Safety Device", each of which have the same inventor as the present application.

FIELD OF THE INVENTION

This invention generally relates to water-alcohol injection systems.

BACKGROUND

Water-alcohol injection systems for use in internal combustion engines are known in the art. These systems provide users of such devices with significant vehicle power advantages. By injecting water and alcohol to the fuel-air mixture entering the combustion chamber, an engine's power output may be greatly increased while simultaneously decreasing the combustion chamber's temperature.

Although these are just two of the benefits that one may obtain when using prior art water/alcohol-injection systems, prior art systems are limited in many respects. For example, current water/alcohol injection systems require a user to perform a significant manual "tuning" of the system upon installation. Tuning prior art water/alcohol injection systems upon installation typically requires configuring settings within engine and injection system controllers. For example, prior art systems may comprise an injection level selector on a system component. Often, upon installation, a user is required to adjust the injection amount—if the engine experiences combustion quench, also known as "bucking", the injection amount is decreased. Bucking occurs when too much water or a water/alcohol mixture is put into the combustion chamber, retarding power output. Other adjustments, such as, but not limited to, mechanical adjustments of the pump or nozzle may also be required to adequately set the injection level for specific engine power levels. Tuning a system upon installation of a water/alcohol system is time consuming and can be difficult to perform correctly, especially for a novice of automotive upgrades.

Additionally, prior art water/alcohol injection systems do not automatically inject an amount of mixture calculated to maximize the power output at any given engine state. For example, prior art injection system controllers generally lack the capacity to provide a precise amount of water/alcohol mixture to create the maximum power without creating engine "knocking". Engine knocking occurs when the air/fuel mixture in the cylinder has been ignited and the typical smooth burning within the chamber is interrupted by the unburned mixture in the combustion chamber exploding before the flame front can reach it. The resulting shock wave creates a knocking sound against the chamber walls.

Prior art systems are additionally defective in their display of operational data to the user and the features they provide. Many prior art systems do not provide the user with information the user needs to continually run the system in the most efficient manner possible. Also, prior art systems do not allow active and real-time or near real-time control of injection of a water/alcohol mixture.

DETAILED DESCRIPTION

Figure 1:
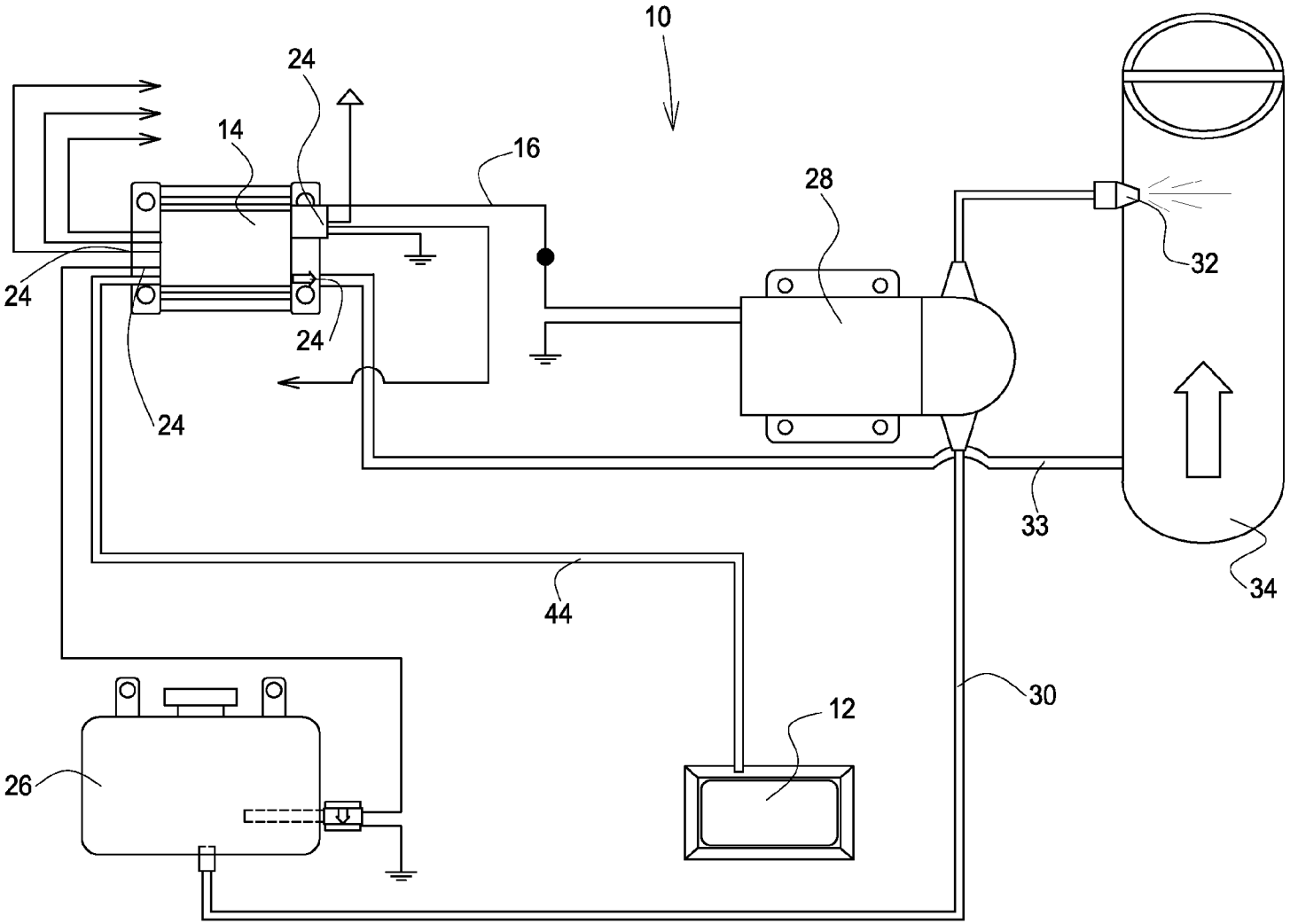
FIG. 1 is a diagram of a water-alcohol injection system coupled to an internal combustion engine according to one embodiment of the invention.

One embodiment of a water/alcohol injection tuning system requires minimum system tuning upon installation into a vehicle. Once user-supplied parameters are correctly entered into a system component such as, but not limited to, system software, one embodiment may automatically perform many steps which were previously required to be manually performed in prior art systems. For example, in one embodiment, after installing the mechanical components to a vehicle, powering on the system, and subsequently inputting parameters into the system software, the system may automatically inject an amount of water and alcohol into the engine to increase power output to an optimum maximum level for a given engine and injection system state.

In one embodiment, the user may input a mixture injection initiation point into the software. At one mixture injection point, the system may begin to inject an amount of water-alcohol mixture into an engine air intake compartment. One embodiment's mixture injection amount may be initiated at a system parameter setting such as, but not limited to, a boost initiation pressure which may be the intake valve pressure level as set by the user. One embodiment may receive additional user-supplied parameters such as, but not limited to, an estimated flywheel horsepower of the vehicle, the number and type of nozzles used in the injection system to inject the mixture into the engine, and a pump type. These parameters may be used by system to determine a mixture injection amount to maximize power output.

Installation of a system may require installing electrical and mechanical components such as, but not limited to a mixture delivery system, a system monitor, and a control module. The delivery system, monitor, and module may be operatively coupled to each other or other system components through electrical wiring and/or tubing. One delivery system may be comprised of a mixture supply container such as, but not limited to, a reservoir or tank. The delivery system may also include the pump operatively coupled to the tank and a nozzle. The control module may be operatively coupled to the system monitor and the pump.

One embodiment's system monitor may be comprised of a liquid crystal display (LCD) which overcomes the inadequate displays of the prior art—allowing the user to easily locate and change graphical displays of system parameters. The LCD may be a dashboard mounted touch-screen adapted to receive the user's input parameters. The monitor may be operatively coupled to the control module through the electrical wiring which allows the monitor to transfer the user-supplied parameters to the module. The module may be comprised of a microprocessor or other similar electronic component adapted to store the parameters.

In one embodiment, the tank, pump, and control module are coupled to the vehicle inside of the vehicle's engine compartment. One or more nozzles may be coupled to the engine air intake compartment such as the intake manifold. The system module may receive power from a vehicle key-on source. In one key-on embodiment, when power is supplied to the vehicle through a method such as, but not limited to, turning an ignition key, the control module receives electrical power and may supply power to the pump and system monitor.

Upon power-on of the system monitor, one system monitor may provide the user with 3 screen options. One screen may be a monitor screen, one screen may be a set up screen, and one screen may be a display screen. Each screen may allow the user to input, view or change different system variables in real-time or near real-time. In one system, upon system installation and a user inputting and saving the parameters into the microprocessor, the alcohol-water mixture may begin to be injected into the intake manifold at the user-specified injection initiation point such as, but not limited to, the specified boost pressure level discussed earlier.

Upon initiating mixture injection into the engine, one system receives data from at least one engine component such as, but not limited to, the fuel injector. The data may be used by the control module to determine the amount of mixture to supply to the engine. The amount of mixture injected may be determined in one embodiment by an algorithm embedded on the microprocessor. Other embodiments and methods may employ software or hardware to perform this or other functions adapted to help determine the amount of mixture to inject. One algorithm may incorporate the user-supplied parameters into the mixture-injection calculation. By using an algorithm based upon user-supplied parameters, the amount of mixture injected into the system may generally automatically and continually maximize cooling, limit detonation, and increase power output without the need to manually adjust system parameters.

A system may also allow a user to further adjust system variables such as, but not limited to, the mixture input level, perform mechanical component adjustment of the system, and adjust user-supplied input parameters to further maximize cooling, limit detonation, and increase horsepower. Some parameters may be adjusted through the system monitor on a real-time or near real-time basis. In one version the user may be able to change mechanical components such as, but not limited to, nozzles and pumps to further increase horsepower, limit detonation, and maximize cooling.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of phrases like "in one embodiment", "in an embodiment", or "in a variation" in various places in the specification are not necessarily all meant to refer to the same embodiment or variation.

The term "couple" or "coupled" as used in this specification and the appended claims refers to either an indirect or direct connection between the identified elements, components or objects. Often the manner of the coupling will be related specifically to the manner in which the two coupled elements interact.

The term "integrate" or "integrated" as used in this specification and the appended claims refers to a blending, uniting, or incorporation of the identified elements, components or objects into a unified whole.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

The term "software" as used in this specification and the appended claims refers to programs, procedures, rules, instructions, and any associated documentation pertaining to the operation of a system.

The term "firmware" as used in this specification and the appended claims refers to computer programs, procedures, rules, instructions, and any associated documentation contained permanently in a hardware device. May also be flashware.

The term "hardware" as used in this specification and the appended claims refers to the physical, electrical, and mechanical parts of a system.

One Embodiment of a Water/Alcohol Injection Tuning System

As best shown in FIGS. 5A through 8, one embodiment of a water-alcohol injection system 10 may be adapted to inject water, alcohol, such as but not limited to methanol, a mixture of water and alcohol, or other liquids into an internal combustion engine. One injection solution may be referred to as "mixture". One mixture may comprise 50% water and 50% methanol. One such vehicle the system may work with is an automobile.

Figure 7:
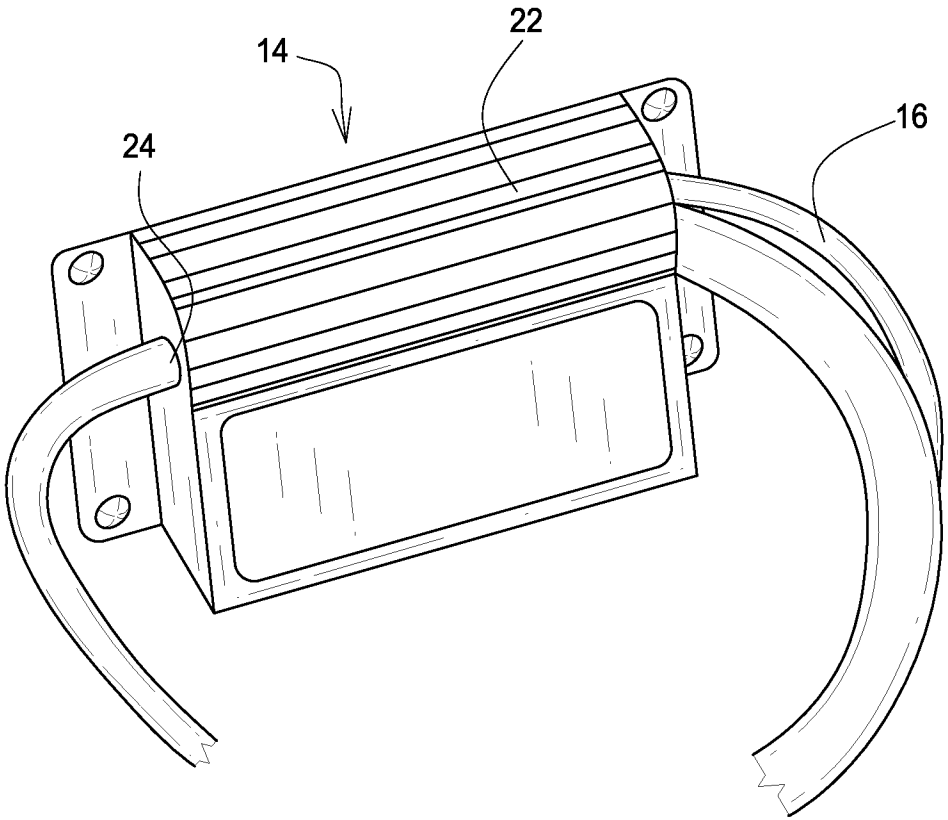
FIG. 7 is an isometric view of an installed control module according to one embodiment of the invention.
Figure 8:
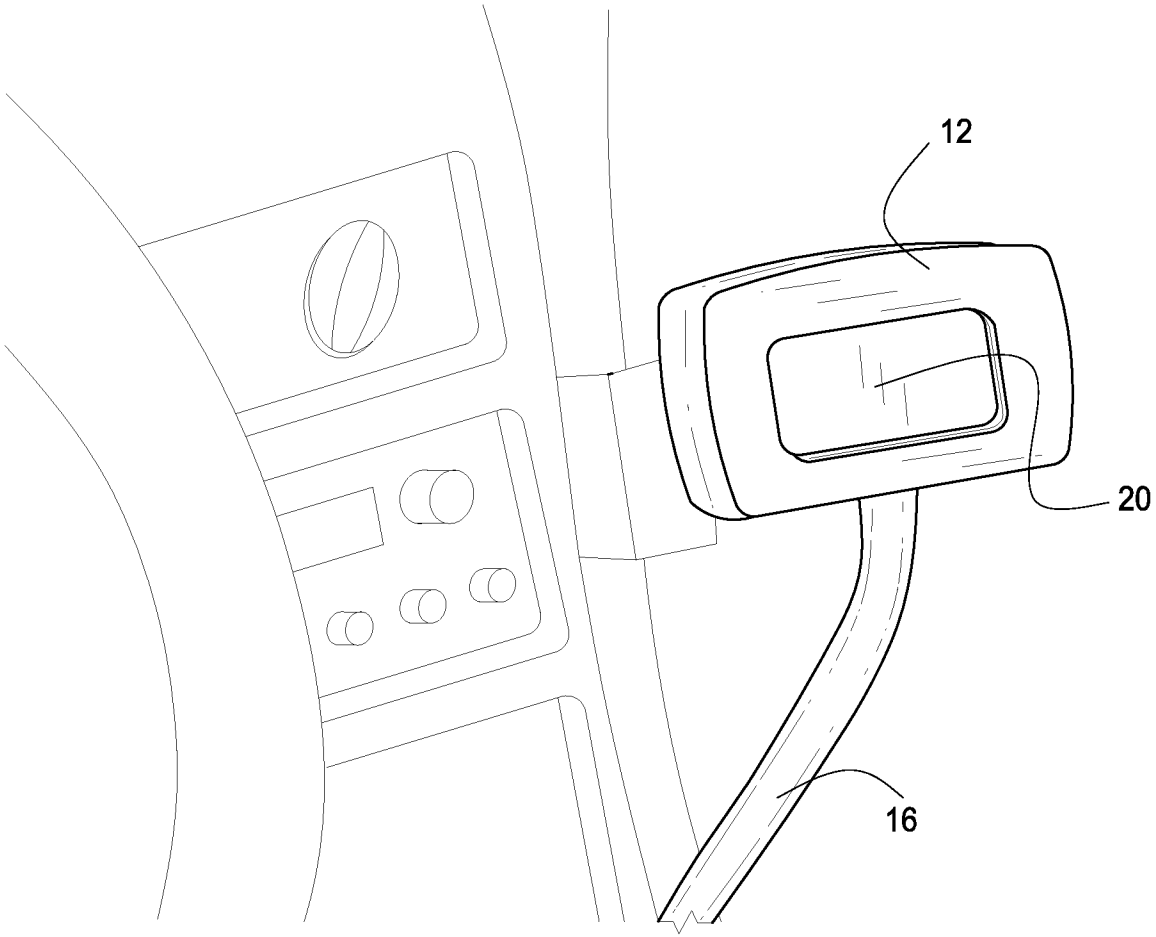
FIG. 8 is an isometric view of an installed system monitor according to one embodiment of the invention.

One water-alcohol injection system 10 may be comprised of a system monitor 12 and a control module 14. The system monitor may have a display screen 20, such as, but not limited to a LCD, as best shown in FIG. 8. The screen may be adapted to display different injection system parameter levels. The control module, as best shown in FIG. 7, may be comprised of a housing 22, a plurality of connectors 24 and an electrical signal generator such as, but not limited to, a microprocessor. One electrical signal generator may control a signal sent or received by a connector. A signal may also be controlled by software. Other signals may be controlled by hardware, firmware, or otherwise. One control module connector may be adapted to operatively receive data input by a user. User data and signals sent and received by an electronic signal generator may be used to determine an amount of mixture to input into the engine. The user data may be referred to as user-supplied input parameters, parameters, information, data, variables, or any other similar variation or wording conveying the same concept.

As best shown in FIGS. 7 and 8, a water-alcohol injection system 10 may also be comprised of electrical wiring 16. The electrical wiring may operatively couple to system components and may be adapted to allow electrical signals to pass between the system components. For example, the electrical wiring may operatively couple to the control module 14 and system monitor 12. Electrical wiring may couple to other system components as well.

Figure 5A:
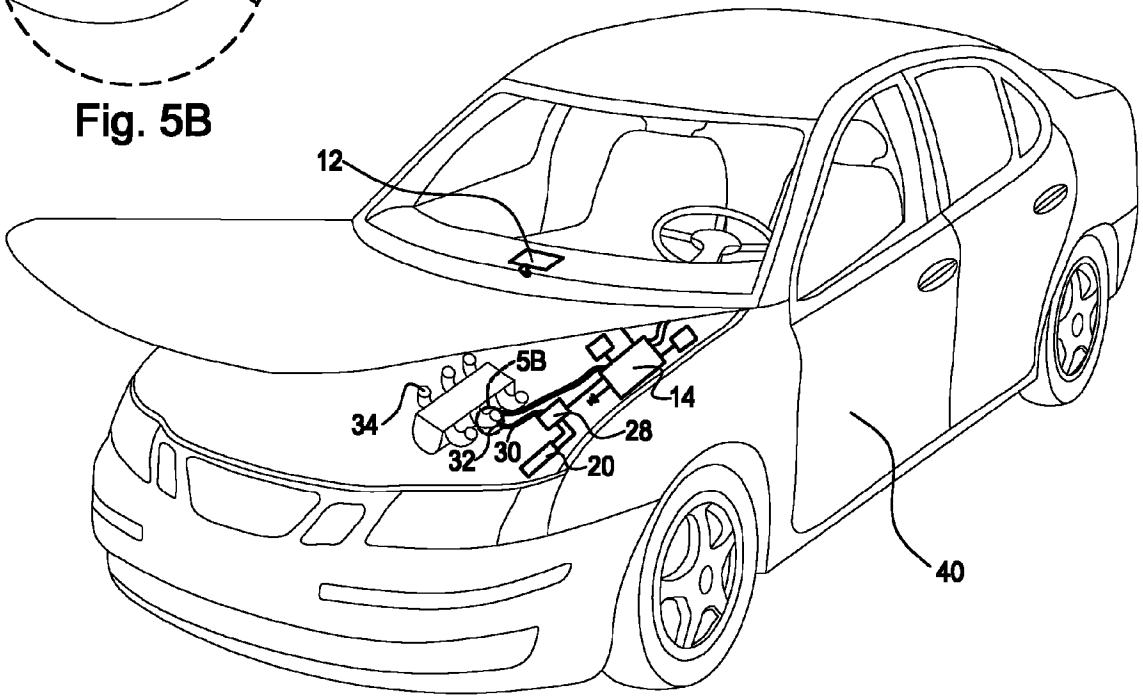
FIG. 5A is an isometric view of a vehicle with an installed injection system according to one embodiment of the invention.
Figure 5B:
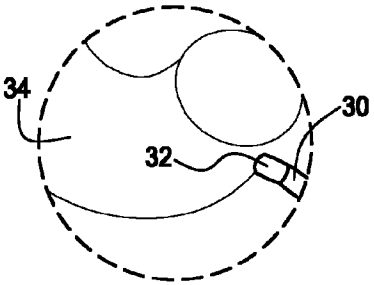
FIG. 5B is an isometric view of a manifold with a coupled nozzle and tubing
Figure 6:
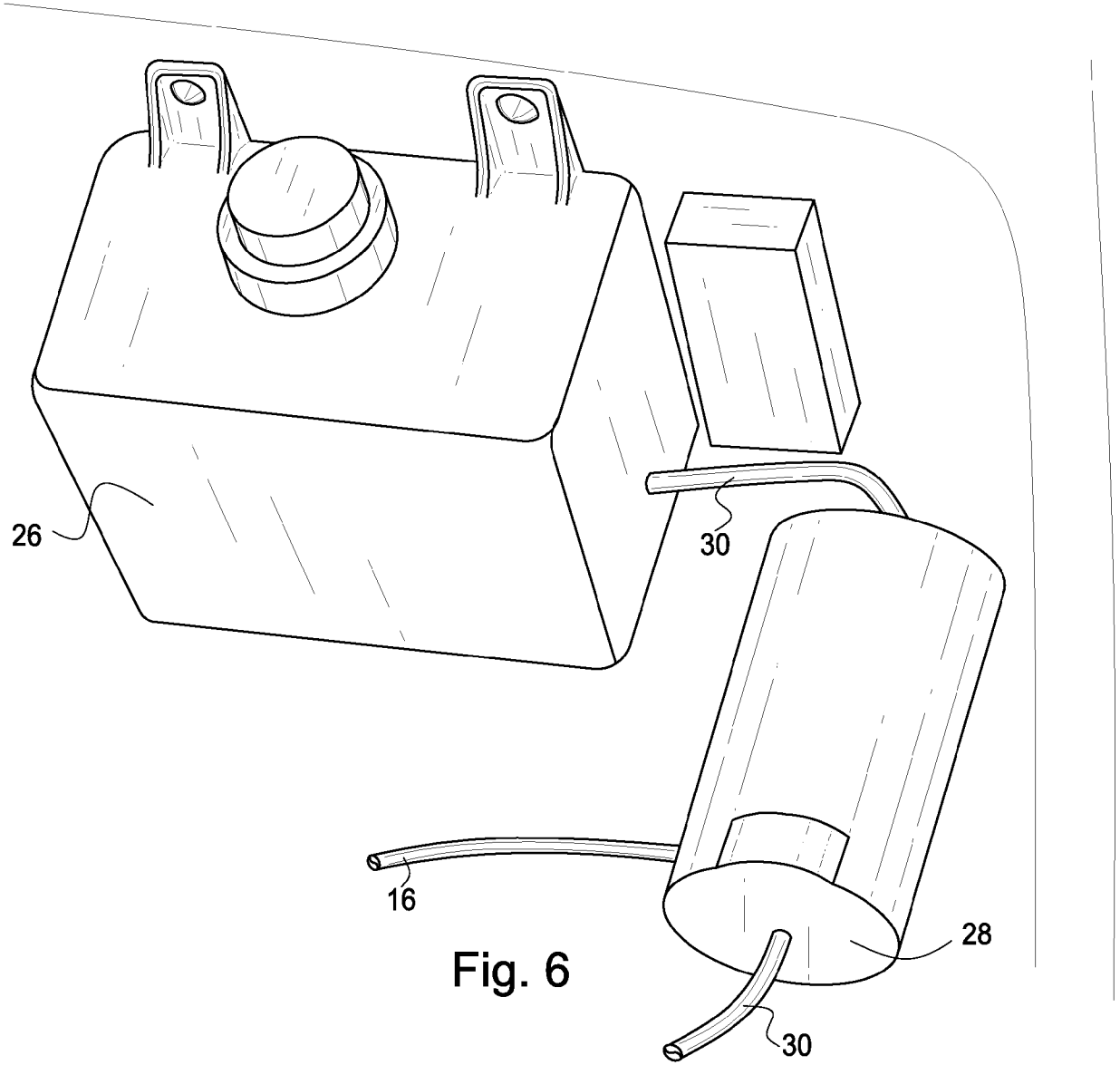
FIG. 6 is an isometric close-up view of an installed tank and pump.

A mixture delivery system 18 is also included in a system, as best shown in FIGS. 5B and 6. The mixture delivery system may be comprised of a pump 28, a reservoir tank 26, tubing 30, and a nozzle 32. The pump may be referred to as a pressure source. The reservoir may be adapted to hold water, alcohol, a mixture of the two, or any other type of liquid. The reservoir may send the liquid to the pump through the tubing, the tubing being adapted to hold the liquid under pressure. The pump may then send the liquid through tubing to the nozzle, which may inject the mixture into an engine intake manifold 34.

One embodiment's control module 14 may be installed in a vehicle's engine bay, as best shown in FIG. 5A. One module housing 22 may be comprised of steel, steel alloy, aluminum, aluminum alloy or another metal or material adapted to withstand extreme temperature swings within an engine bay such as, but not limited to, a composite material. In addition to connectors, one control module may also be comprised of the microprocessor. The microprocessor may be located within the module, generally surrounded by the housing. The microprocessor and may be adapted (through software, firmware, or otherwise) to determine an amount of mixture to inject into a vehicle's air intake chamber for any given engine parameters. Other embodiments may use different mechanisms and electronic signal generators to perform this function. In one embodiment, the control module may be potted, such as a heat resistant epoxy material.

Referring to FIG. 1, in one embodiment, a control module's 14 microprocessor may be coupled to a circuit board which is operatively coupled to at least one connector 24. The circuit board may be adapted to allow electronic signals to be sent and received between the connector and the microprocessor. One signal sent by a microprocessor electronic signal generator may be sent to the circuit board and subsequently sent to the connector. One electronic signal generator may be viewed as being operatively controlled by a software program. One software program may be embedded on the microprocessor. In one embodiment, a software program may use an algorithm to determine what electrical signal is sent by the signal generator. This algorithm may access the user-supplied parameters to determine the signal to send.

One electronic signal may be operatively sent from the electronic signal generator to the pump 28. One signal may signal the pump to send mixture to an operatively coupled nozzle 32 that is coupled to the air intake manifold 34. One nozzle may be coupled to the manifold in a manner allowing the nozzle to spray mixture into the manifold. In one embodiment, an electronic signal sent to the pump may signal the pump to operative send a level of mixture from the reservoir tank 26 to the nozzle. In this manner, in one embodiment, based on the user-supplied parameters as well as other engine supplied data, an amount of mixture may be sprayed into the engine in order to increase the vehicle's power.

An embodiment's user supplied parameters used by the system to inject an amount of mixture to an engine component may be comprised one or more of the following: an injection initiation point, the estimated maximum vehicle power level, the number of injection devices, the injection device type, and the pump type. Other input parameters may be used. One injection initiation point may be a certain boost pressure level. For example, one control module 14 may be comprised of a connector 24 operatively coupled to read the pressure in a vehicle's air intake manifold 34. Through a pressure gauge operatively coupled to the intake manifold (or plenum), the amount of pressure in the manifold due to boost input such as, but not limited to a turbo or supercharger device may be able to be determined. This pressure level may be received by the microprocessor. In one embodiment, if the boost pressure level is above a user-specified boost pressure level, the control module will operatively send a signal for the tank to begin to release mixture to the engine. Other injection initiation points besides boost pressure level known in the art may also be used.

One embodiment's control module 14 stores the system parameters on the microprocessor. Other embodiments may user other mechanisms or methods to store the parameters such as, but not limited to hardware and software. The microprocessor may receive the user supplied system parameters from the operatively coupled system monitor 12. The system monitor may be comprised of a liquid-crystal display ("LCD") adapted to receive inputs from a user through the user entering the data on the screen (i.e., the LCD is a "touch screen"). In one embodiment, when the system is correctly installed and the system is powered on, the system monitor receives power, changing the screen from an "off" mode, where the screen is blank, to an "on" mode, where graphical representations are on the screen.

When one system monitor 12 is in the on mode, the user, through a stylus or otherwise, may select, possibly through different screen choices, the ability to enter data into the system. For example, in one system monitor, the user may set the injection initiation point at a pressure level which is about of ⅓ the maximum boost pressure level for the boost system installed on the vehicle. One vehicle may have a turbocharger installed with a boost controller and spring able to achieve a maximum boost pressure level of 15 psi. In such a system, the mixture may be introduced into the engine when the boost pressure reaches 5 psi.

The system monitor 12 may also allow a user to enter the estimated maximum power level and injection device information. Estimated maximum power level may be comprised of the estimated flywheel horsepower of the system, or another power level reading or readings may be used. Also, injection device information such as, but not limited to, the number and type of nozzles 32 coupled to the engine, may also be entered into the system at this point. Other parameters known in the injection art may also be entered.

When the system parameters are set within one injection system 10 and the control module 14 receives a signal that the injection initiation point has been reached by the engine, the system begins to initiate injection flow. To determine the level of mixture that is sent to the engine, in one embodiment, the algorithm used by the software embedded on the microprocessor may incorporate factors such as the boost pressure level and one of injector duty cycle level and exhaust gas temperature.

For example, one control module connector 24 may receive the boost pressure level from the manifold 34 and supply the information to the microprocessor. Software may calculate the injector duty cycle as well. Injector duty cycle may be determined with information such as, but not limited to, the engine speed (rpm) and the injector pulse width. In one embodiment, the injector duty cycle, displayed on the system monitor 12 as a percentage of time the injector is being utilized, is used in conjunction with the boost pressure to determine the amount of mixture that is injected into the engine. The information needed to determine the injector duty cycle may be supplied to the control module 14 from an operatively coupled fuel injector through electrical wiring 16.

In an alternative embodiment, possibly a diesel adapted embodiment, the amount of mixture to inject into the engine may be based on the boost pressure level and the exhaust gas temperatures (EGTs). Like an injector duty cycle embodiment, one exhaust gas temperature embodiment may utilize both boost and EGTs to modulate injection. The EGTs may be sent form a temperature probe. One type of temperature probe is a k-type probe mounted to receive temperature from an exhaust manifold in a pre-turbo location. A probe may be comprised of a shielded lead about 10 inches long adapted to couple to a control module connector. The system monitor may also display EGT level.

Besides being capable of receiving, sending, and displaying user-supplied parameters, the system monitor 12 may also be capable of displaying and adjusting other system information in one embodiment. For example, a monitor screen may display an injection parameter. One injection parameter displayed may be a pump output percentage. One injection parameter displayed may be an injection flowrate. One injection flowrate may be displayed as ml/min. An injection flowrate may be displayed if a safety device is operatively coupled to the control module.

A gain parameter may also be displayed and adapted to be adjusted on the system monitor 12. The gain may be displayed as a percentage increase or decrease in the injection flowrate as determined by the algorithm or by an injection curve whose information may be embedded on the microprocessor. Other ways to set the injection flowrate are also contemplated. The gain may allow a user to increase or decrease the injection amount above or below this level up to a 15 percent level in either direction. This may allow the user to more fully (and manually) optimize the system and may allow a user to increase or decrease mixture injection in real-time while injection is occurring. In one embodiment, such as, but not limited to, a diesel embodiment, the gain may be displayed in a 100 percent display range, allowing a user to adjust the gain above or below the maximum gain level.

Along with the injection system initiation point and the estimated power level, the system monitor 12 may allow a user to configure the system for use with up to three injection devices in one embodiment. The injection devices in one embodiment may be nozzles 32, and a user may configure each of the injection devices for a nozzle size from "NONE" up to 625 ml/min. Additionally, the user may set in the system a pump 28 size as well. Lastly, in one embodiment, the system may be adapted to set display parameters such as, but not limited to, screen brightness, screen contrast, volume, and other display parameters.

In one embodiment, the information received by the system monitor 12 is stored on the control module 14. One control module may be comprised of a connector 24 adapted to receive a wire harness 28. One wire harness may be comprised of 4 wires. One of the four wires may couple to the pump, one may couple to a power supply, one wire may couple to a vehicle ECU or fuel injector and one may couple to a ground location. A control module 14 may also be comprised of a communication harness connector adapted to receive a wire communication harness 44 that is also operatively coupled to the system monitor 12.

In one injection system 10 version, a control module 14 may also have optional connector 24 ports. For example, one control module may have four optional connectors. One connector may be operatively coupled to a fluid level switch adapted to receive a signal when a mixture fluid level reaches a specified amount in the tank 26. The signal may be sent to the microprocessor in one embodiment, and the microprocessor may initiate a signal sent to the system monitor. The system monitor may receive the signal and display an icon or other display on the LCD to inform the user that a specified fluid level has been reached. The system monitor may also emit a sound. In one embodiment, the control module may receive the fluid level signal from the tank 26.

Another optional connector 24 may be a power output connector. One power output connector may drive a solenoid, a NOS relay, or a safety device, such as, but not limited to, a SafeInjection™ Unit. One SafeInjection unit may be a unit that sends a signal to a blow off valve solenoid to evacuate boost if mixture flow is retarded. Other optional connectors may be adapted to couple to another safety unit. For example, if a safety device sends a signal that a system fault has occurred, the optional connector may receive the signal, send it to a microprocessor, and a signal may be sent to the system monitor to display an icon and may also emit a sound. Finally, a flow signal optional connector may be present in one control module. The flow signal connector may receive a signal from a flowmeter and this signal may be operatively sent to the system monitor, which may display the mixture flowrate in ml/min. It is to be appreciated that displaying other system parameters are also contemplated.

One Method of Injecting a Liquid into an Internal Combustion Engine:

As best shown in FIGS. 1 through 4, one method of injecting a liquid into an internal combustion engine may be comprised of using an injection system 10. One injection system may be comprised of system monitor 12, a control module 14, a pump 28, electrical wiring 16, and a reservoir tank 26. A method may include injecting water, alcohol such as, but not limited to methanol, or a mixture of water and alcohol. It is contemplated that a method may use other liquids as well.

In one method, the control module 14, tank 26, and pump 28 are installed into the engine bay of a vehicle such as, but not limited to, an automobile. The system monitor 12 may be installed in a passenger compartment such as, but not limited to, on the dashboard of an auto. Installation may include a method step of providing power to the system through a key-on source. In one method, when a car is powered on, the system may receive power, powering on system monitor. One version's system monitor powers on by displaying information on a liquid crystal display (LCD).

Figure 2:
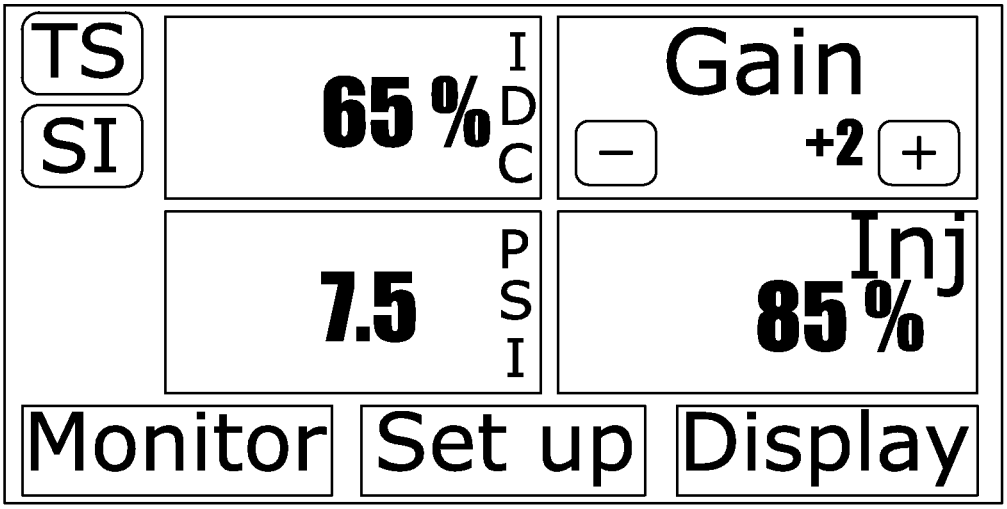
FIG. 2 is a front view of a system monitor screen showing the "Monitor" menu according to one embodiment of the invention.
Figure 3:
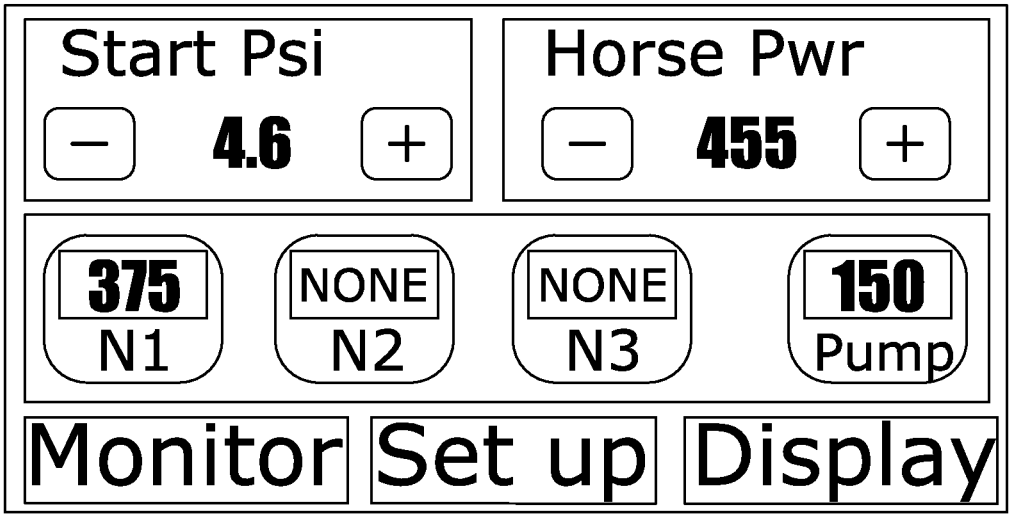
FIG. 3 is a front view of a system monitor screen showing the "Set Up" menu according to one embodiment of the invention.
Figure 4:
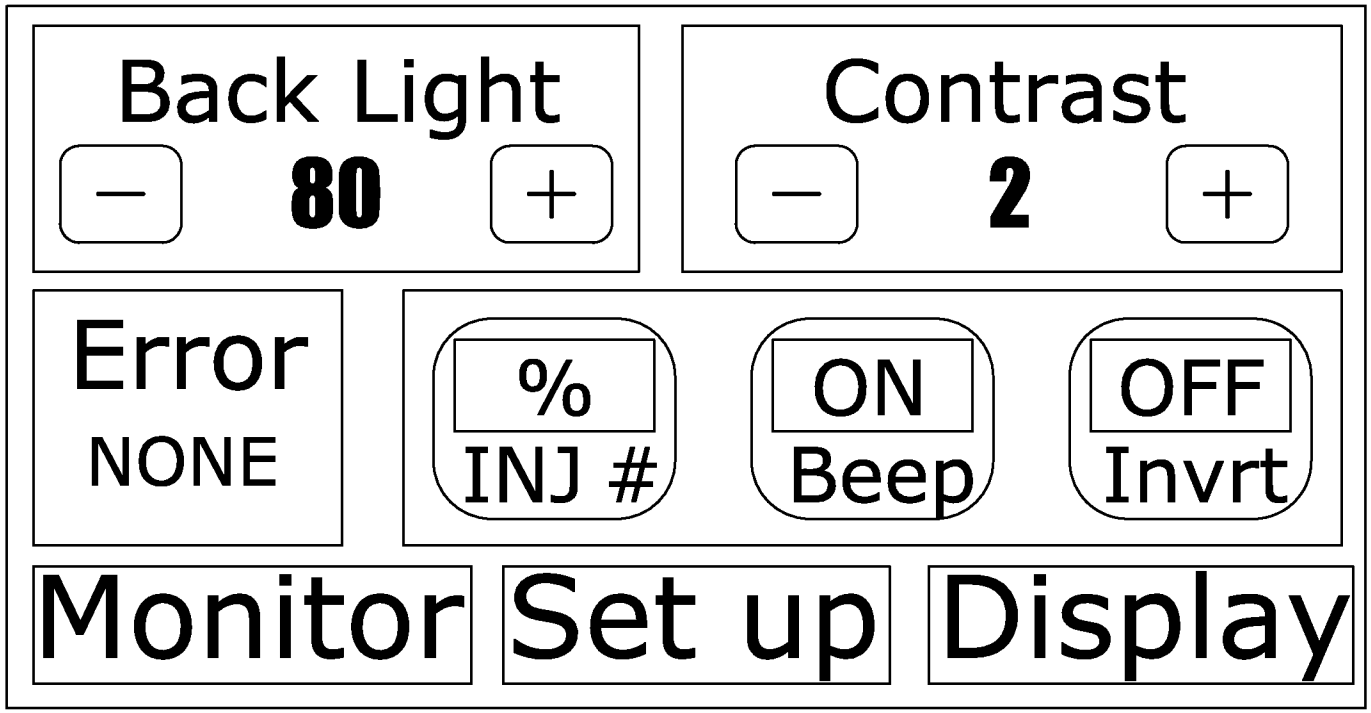
FIG. 4 is a front view of a system monitor screen showing the "Display" menu according to one embodiment of the invention.

As best shown in FIGS. 2 through 4, three screens may be displayed on the system monitor. One screen, as best shown in FIG. 2 may be the Monitor screen. In one Monitor screen, the Injection Duty Cycle (IDC), Gain level, Boost Pressure, and Injection may be shown. The IDC may be shown as a percentage of the injector's on-time per engine revolution. Boost pressure may be shown in psi and a maximum psi displayed may be 30 psi in one embodiment. Additionally, the Injection may be shown as an mixture injection amount displayed as a percentage of the pump output or in a ml/min flowrate.

The Monitor screen may also display system icons. For example, as best shown in FIG. 2, the Monitor screen may have a Test System (TS) icon. When the TS icon is pressed, in one embodiment, the injection system will override normal operation and drive the pump at 50% of maximum. This may be done in order to determine if the system is properly installed. For example, upon pressing the TS icon, in one embodiment, the engine may bog or stumble and the user may then turn the engine off to inspect the stem for any fluid leaks. If the engine does not stumble or bog, electrical connections and fluid lines may be checked for proper installation, repaired, and the system may be checked again.

Other system icons may also be displayed on one system monitor. One icon may be an Error (ER) icon. One ER icon may be displayed if the system detects an error. A user may then switch to a Display Screen, as best shown in FIG. 4, to determine the error code associated with the ER icon. One embodiment may display a "pump", "I+12", "Comm", and "SI" error codes. One pump error code may inform a user that the pump is clogged or faulty. An I+12 code may inform a user that a connector is not receiving a proper signal. Specifically, in one embodiment, an option or auxiliary connector such as, but not limited to, a 12 volt power output connector may not be operating properly due to a shorted wire, a failed device, or otherwise. A Comm error may inform a user that a communication error has occurred between the control module and the system monitor, with the SI code may inform the user that a coupled safety device such as the SafeInjection™ system has tripped an injection flow fault.

In addition to error codes, the Monitor screen can display two additional icons—the FL and SI icon. The FL icon may be displayed and the system monitor may beep when the system detects a low fluid condition. Also, the SI icon may be displayed and the system may beep in the even the safety unit such as the SafeInjection system detects a fault.

As best shown in FIG. 3, the Set up screen may display the Start Psi, Horse Power, Nozzle Selection, and Pump. The Start Psi may be the boost pressure for when the injection system will activate. The Horse Power may be the estimated flywheel horse power of the vehicle. Nozzle selection may include configuring up to three nozzles and the Pump may allow selection between different pumps.

As best shown in FIG. 4, a Display screen may display Back Light, Contrast, INJ #, Beep, and Invrt, besides displaying the Error codes discussed earlier. The Back Light function adjusts the intensity of the display. The Contrast adjusts the contrast of the display. The INJ # may allow a user to toggle between "%" and "ml" which changes the Injection display on the Monitor screen. Beep may turn on and off a speaker on the system monitor. Invrt is an option which allows a user to invert the coloring on the system monitor display.

In one method the LCD may allow a person to set an injection initiation point. For example, when the system is powered on, the system monitor 12 may display a "Set up" screen. In one set up screen, a user may be allowed to enter at what engine parameter or parameters the injection system 10 may begin to inject liquid into an engine component to increase engine power output. For example, as best shown in FIG. 3, a user may set "Start Psi" as an injection initiation point. One Start Psi (pounds per square inch) may be a boost pressure level. A boost pressure level may be determined by operatively coupling the intake manifold 34, or plenum, and to a control module 12 in a manner adapted to allow an injection system component to read the pressure and save the pressure to the control module.

A method to inject a liquid into an internal combustion engine may also include a user inputting one or more set-up parameters to the system. The parameters in one embodiment may be input through a system monitor 12 component such as, but not limited to, the LCD. One method may also include a method step of storing the parameters. For example, upon receiving the parameters, the system monitor may electronically transfer the data received from the user to the control module 14. In one embodiment, the control module may store the parameters within a microprocessor. However, other control module storage devices such as, but not limited to, software or a hardware device or devices may also be used.

Upon receiving and storing the input parameters to the system, in one method the system is adapted to, and subsequently does, receive engine-supplied information. For example, when one system's control module is operatively coupled to an engine's intake manifold 34, which may include an electrical or mechanical coupling method and a pressure gauge, the control module may supply the control module with the boost pressure. One type of boost pressure may be the pressure supplied to the intake manifold from an installed turbocharger. Other boost devices such as, but not limited to, a supercharger may also be employed.

When the control module 14 receives engine-supplied information such as, but not limited to, the boost pressure, the control module in one embodiment sends a signal to initiate a mixture supply to the engine. For example, when one method's the control module receives the boost pressure from the engine air intake manifold 34, that pressure level may be sent to a control module system component such as, but not limited to, the microprocessor. The microprocessor may determine if the boost pressure or other engine-supplied information is at a level where the control module should send a signal to the mixture delivery system initiating mixture supply to the engine. The control module may use a program such as, but not limited to, a software program, to determine the amount of liquid to inject into an engine component. In one method, the mixture is supplied to an engine's metal air inlet tube as close as possible to the throttle body when the boost pressure level is higher than the injection initiation point such as, but not limited to, the Start Psi.

One method supplies mixture to the intake manifold 34 by receiving power from an engine key-on source. For example, a control module 14 may have a connector 24 which is adapted to receive 12V of electrical power from the engine. The control module may receive the power when the engine is powered on. The control module may then supply power to the pump 28 and the system monitor 12.

Upon the system powering on and the control module 14 receiving a signal to begin initiating a mixture supply to the engine, the control module may send a signal to an operatively coupled pump 28 in one method. The signal to the pump may allow an operatively coupled reservoir tank 26 to initiate sending one or both of water and alcohol, or any other liquid, to an operatively coupled nozzle 32. The nozzle in one embodiment is adapted to inject, and may sprayingly inject, the liquid into an engine component such as, but not limited to, the air inlet tube.

One program used by the system 10 to determine the level of liquid to inject into the engine calculates a liquid amount to inject which generally maximizes the engine's power output. For example, in one method, a software program may access user supplied data such as, but not limited to, the injection initiation point, estimated power level, number of injection devices, injection device type, and pump type. The software may also receive other information supplied to the control module. For example, the software may use injection flowmeter data supplied to the control module 14 from an engine component such as, but not limited to, a fuel injector. In one method, the software utilizes an algorithm which uses at least some of this information in automatically determining the signal to send from the control module to the pump 28 so the pump may inject the correct amount of liquid from the nozzle 32. In this manner, in one method, the injection system performs an automatic tuning of the system upon installation. In another method, a user may manually adjust the ignition timing of the vehicle that the system is installed in, or perform other tuning functions to manually increase the power output or lower the temperature of the engine.

One method's algorithm may receive real-time or near real-time data from the engine. A method's control module 14 may receive 2 real-time or nearly real-time parameters from an engine component or another injection system component. One parameter may be the boost and one may be the injector pulse width. A system may also use the exhaust gas temperatures in one method. A method may initiate injection into the engine at or about at ⅓ the maximum boost pressure for the boost device or devices on the engine. One method may also automatically set the mixture injection initiation point (through software or through input from an ECU or through inputting other parameters such as, but not limited to, type of car, engine, etc.).

Other Embodiments and Variations

The embodiments of the water/alcohol injection tuning system and methods of use as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure.

I claim:

1. An automobile comprising, an internal combustion engine;

an injection system for injecting one or both of water and alcohol into the internal combustion engine comprising, a control module comprising a plurality of connectors, at least one electrical signal generator, and is programmed to receive and store one or more user-supplied parameters, and a mixture delivery system having a pump, tubing, a tank, and a nozzle; and a boost source.

2. The automobile of claim 1, wherein the injection system further includes a system monitor configured to display real-time parameter levels.

3. The automobile of claim 2, wherein the system monitor is configured to display a gain parameter.

4. The automobile of claim 3, wherein the system monitor is further configured to adjust the gain parameter.

5. The automobile of claim 2, wherein the system monitor is dashboard mountable.

6. The automobile of claim 1, wherein the at least one signal generator is (i) configured to calculate an amount of mixture of one or both of water and alcohol to be supplied into the internal combustion engine and (ii) operatively coupled to the mixture delivery system.

7. The automobile of claim 6, wherein the amount of mixture is determined at least in part by incorporating one or more user-supplied parameters.

8. The automobile of claim 6, wherein the amount of mixture is determined at least in part by incorporating a boost pressure level and one of injector duty cycle and exhaust gas temperature.

9. The automobile of claim 6, wherein the amount of mixture is determined at least in part by incorporating injection flowmeter data supplied to the control module.

10. The automobile of claim 9, wherein the injection flowmeter data is derived from a fuel injector.

11. The automobile of claim 1, wherein the control module is configured to receive real-time or near real-time data via the plurality of connectors operatively coupled to one or both of an engine component and another injection system component.

* * * * *